US010021994B1

(12) United States Patent
Lu

(10) Patent No.: US 10,021,994 B1
(45) Date of Patent: Jul. 17, 2018

(54) BOUNCING SUPPORT STRUCTURE FOR BABY WALKER

(71) Applicant: Li-Wei Lu, Taichung (TW)

(72) Inventor: Li-Wei Lu, Taichung (TW)

( * ) Notice: Subject to any disclaimer, the term of this patent is extended or adjusted under 35 U.S.C. 154(b) by 0 days.

(21) Appl. No.: 15/784,558

(22) Filed: Oct. 16, 2017

(51) Int. Cl.
*A47D 13/10* (2006.01)
*A47D 13/04* (2006.01)

(52) U.S. Cl.
CPC ..... *A47D 13/107* (2013.01); *A47D 13/043* (2013.01)

(58) Field of Classification Search
CPC combination set(s) only.
See application file for complete search history.

(56) References Cited

U.S. PATENT DOCUMENTS 3,337,230 A * 8/1967 Golding ..... A47D 13/043 16/44
5,407,246 A * 4/1995 Meeker ..... A47D 13/102 248/372.1
6,854,799 B1 * 2/2005 Asbach ..... A47D 3/00 297/136
2002/0164917 A1 * 11/2002 Keegan ..... A47D 13/043 446/71
2002/0177906 A1 * 11/2002 Phillips ..... A61F 2/60 623/27
2004/0075231 A1 * 4/2004 Hou ..... A47D 13/043 280/87.051
2011/0260507 A1 * 10/2011 Parness ..... A47D 1/08 297/118
2012/0018971 A1 * 1/2012 You ..... A47D 13/043 280/87.051
2015/0048235 A1 * 2/2015 Shereyk ..... B25G 1/01 248/634
2016/0088954 A1 * 3/2016 Burns ..... A47D 1/008 297/258.1

* cited by examiner

*Primary Examiner* — Erez Gurari
(74) *Attorney, Agent, or Firm* — Egbert Law Offices, PLLC

(57) ABSTRACT

A bouncing support structure for baby walker includes a tubular stand, an upper housing and a lower housing respectively sleeved on an upper end and a lower end of the tubular stand, wherein the upper housing and the lower housing are selectively and reciprocally moved relative to the tubular stand, and respectively connected to an upper frame and a lower frame of the baby walker. An expandable tube sleeved on the tubular stand. The expandable tube has two opposite ends respectively connected to the upper housing and the lower housing. A resilient device is received in the tubular stand, wherein the resilient device has a first end secured on the tubular stand and a second end secured on the upper housing. The bouncing support structure provides a bouncing function to the baby walker when the upper housing is reciprocally moved relative to the tubular stand.

6 Claims, 7 Drawing Sheets

BOUNCING SUPPORT STRUCTURE FOR BABY WALKER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a support structure, and more particularly to a bouncing support structure for baby walker.

2. Description of Related Art Including Information Disclosed Under 37 CFR 1.97 and 37 CFR 1.98

A baby desires to stand and walk due to his/her instinct when he/she grows up to about 9 or 10 months old. Parents always prepare a baby walker to support the baby because, now, the baby cannot stand and walk well such that he/she may stumble and be hurt. The baby can be gradually used to stand by his/her legs due with a suitable baby walker. As a result, a baby walker is an indispensable good partner when a baby is growing up. However, the conventional baby walker in accordance with the prior art has only function and cannot satisfy the multiple requirements of modern parents. Consequently, baby walker manufacturers try to provide some new functions to attract the attention of consumers, such as adding toys on an upper frame of the baby walker or providing sound and light effects to the baby walker. However, the horizontal height of the upper frame of the baby walker cannot be adjusted due to the length of baby's legs. Consequently, parents need to prepare a new one when their baby gradually grows up. In addition, the conventional baby walker provides no bouncing function such that the conventional baby walker gradually becomes boring after being used for a period of time.

The present invention has arisen to mitigate and/or obviate the disadvantages of the conventional baby walker.

BRIEF SUMMARY OF THE INVENTION

The main objective of the present invention is to provide an improved bouncing support structure for baby walker and the bouncing support structure has an adjustable height.

To achieve the objective, the bouncing support structure for baby walker in accordance with the present invention comprises a tubular stand, an upper housing and a lower housing respectively sleeved on an upper end and a lower end of the tubular stand, wherein the upper housing and the lower housing are selectively and reciprocally moved relative to the tubular stand, and respectively connected to an upper frame and a lower frame of the baby walker. An expandable tube sleeved on the tubular stand. The expandable tube has two opposite ends respectively connected to the upper housing and the lower housing. A resilient device is received in the tubular stand, wherein the resilient device has a first end secured on the tubular stand and a second end secured on the upper housing. The bouncing support structure provides a bouncing function to the baby walker when the upper housing is reciprocally moved relative to the tubular stand.

Further benefits and advantages of the present invention will become apparent after a careful reading of the detailed description with appropriate reference to the accompanying drawings.

DETAILED DESCRIPTION OF THE INVENTION

Figure 1:
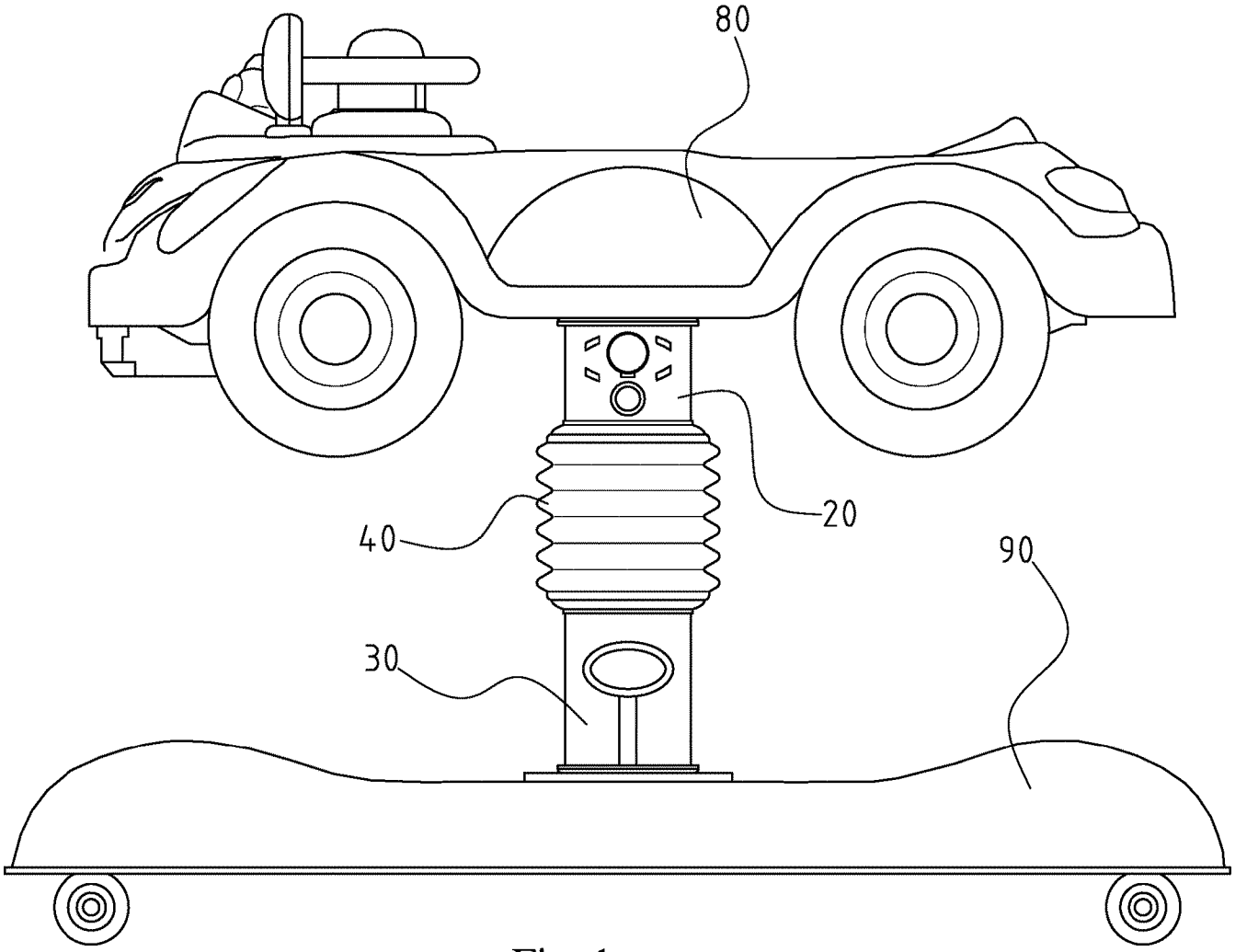
FIG. 1 is a side plan view of a baby walker that has two bouncing support structure in accordance with the present invention.

Referring to the drawings and initially to FIGS. 1-4, a bouncing support structure for baby walker in accordance with the present invention comprises a tubular stand 10, an upper housing 20 and a lower housing 30, wherein the upper housing 20 and the lower housing 30 are respectively longitudinally sleeved on an upper end and a lower end of the tubular stand 10. The upper housing 20 and the lower housing 30 are selectively reciprocally moved relative to the tubular stand 10. The upper housing 20 and the lower housing 30 are adapted to be mounted to an upper frame 80 and a lower frame 90 of the baby walker. An expandable tube 40 is sleeved on the tubular stand 10, wherein the expandable tube 40 has two opposite ends respectively longitudinally connected to the upper housing 20 and the lower housing 30. A resilient device 50 is received in the tubular stand 10. The resilient device 50 has two opposite ends respectively secured on the upper housing 20 and the tubular stand 10. The upper housing 20 and the resilient device 50 provide a bouncing function to the baby walker when the upper housing 20 is reciprocally longitudinally moved relative to the tubular stand 10. In the preferred embodiment of the present invention, the upper housing 20 and the lower housing 30 respectively have a smooth and curved inner periphery, and the tubular stand 10 has a smooth and curved outer periphery for easily sleeving the upper housing 20 and the lower housing 30 to the upper end and the lower end of the tubular stand 10. The expandable tube 40 is made of flexible material and has a continued wave-shaped structure.

The tubular stand 10 is formed with an inner portion 101 and an outer portion 102. The inner portion 101 and the outer portion 102 respectively includes a first through hole 11, a longitudinal slot 12 and second through hole 13 defined therein, wherein the two first through holes 11 diametrically correspond to each, the two longitudinal slots 12 diametrically correspond to each other and the two second through hole 13 diametrically correspond to each other. The inner portion 101 of the tubular stand 10 has a locking hole 14 defined therein under the second through hole 13 in the inner portion 102 of the tubular stand 10. Multiple bores 15 are defined in the outer portion 102 under the second through hole 13 in the outer portion 102. The multiple bores 15 longitudinally align with one another.

Figure 5:
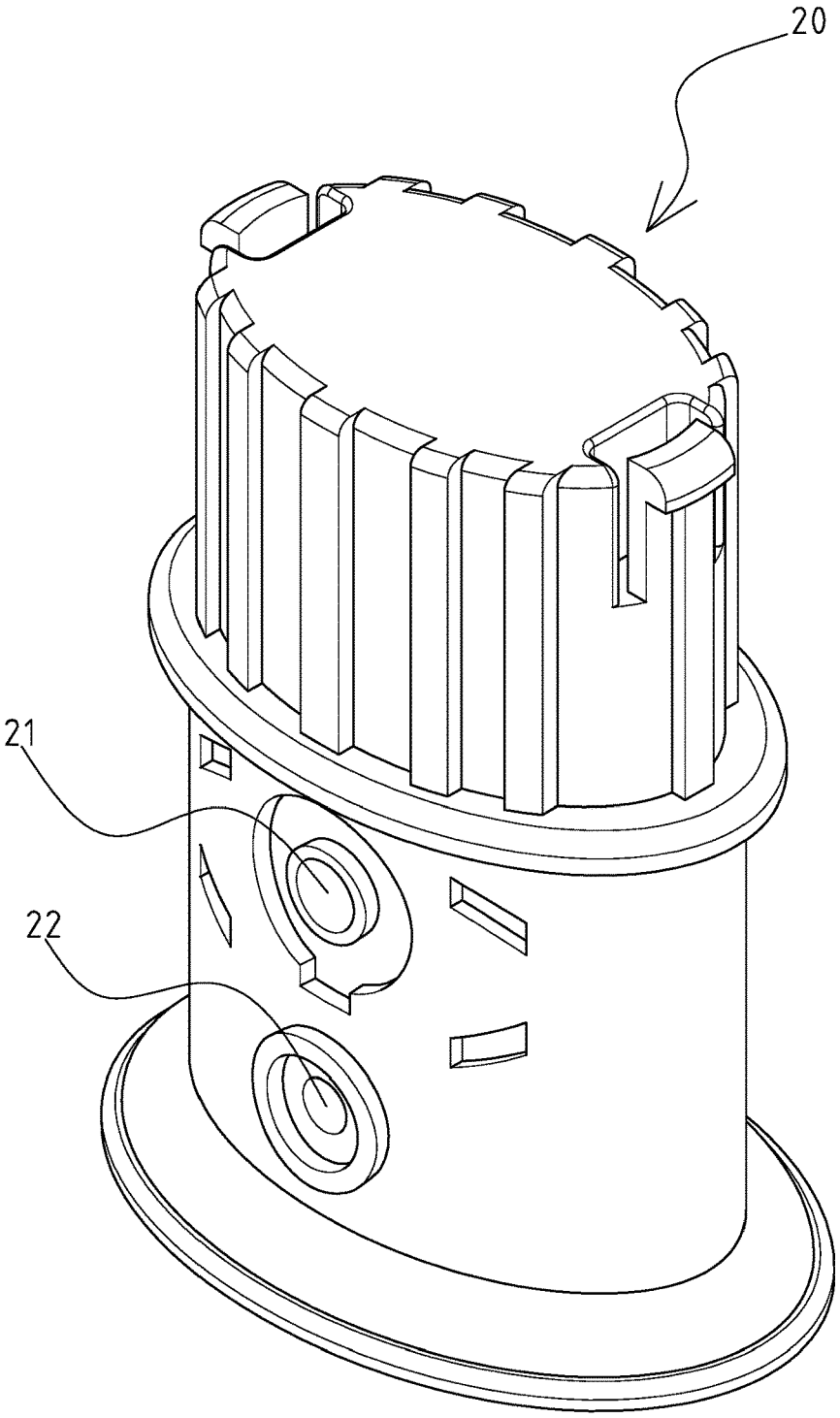
FIG. 5 is a perspective view of an upper housing of the bouncing support structure in accordance with the present invention.

With reference to FIG. 5, the upper housing 20 has a first through hole 21 and a second through hole 22 defined therein, wherein the first through hole 21 in the upper housing 20 aligns and communicates with a corresponding one of the two first through holes 11 in the tubular stand 10 and the second through hole 22 in the upper housing 20 aligns and communicates with a corresponding one of the two longitudinal slot 12. A first locking device 23 is detachably mounted to the upper housing 20. The first locking device 23 includes a first knob 231 rotatably and detachably mounted to the upper housing 20. A first pin 232 is longitudinally secured to the first knob 231. A first spring 233 is sleeved on the first pin 232, wherein the first spring 233 has two opposite ends respectively abutting against the upper housing 20 and the first knob 231. The first pin 232 sequentially extends through the first through hole 21 in the upper housing 20 and the first through hole 11 in the tubular stand 10 when the first knob 231 is mounted to the upper housing 20 such that the upper housing 20 is positioned relative to the tubular stand 10.

Figure 6:
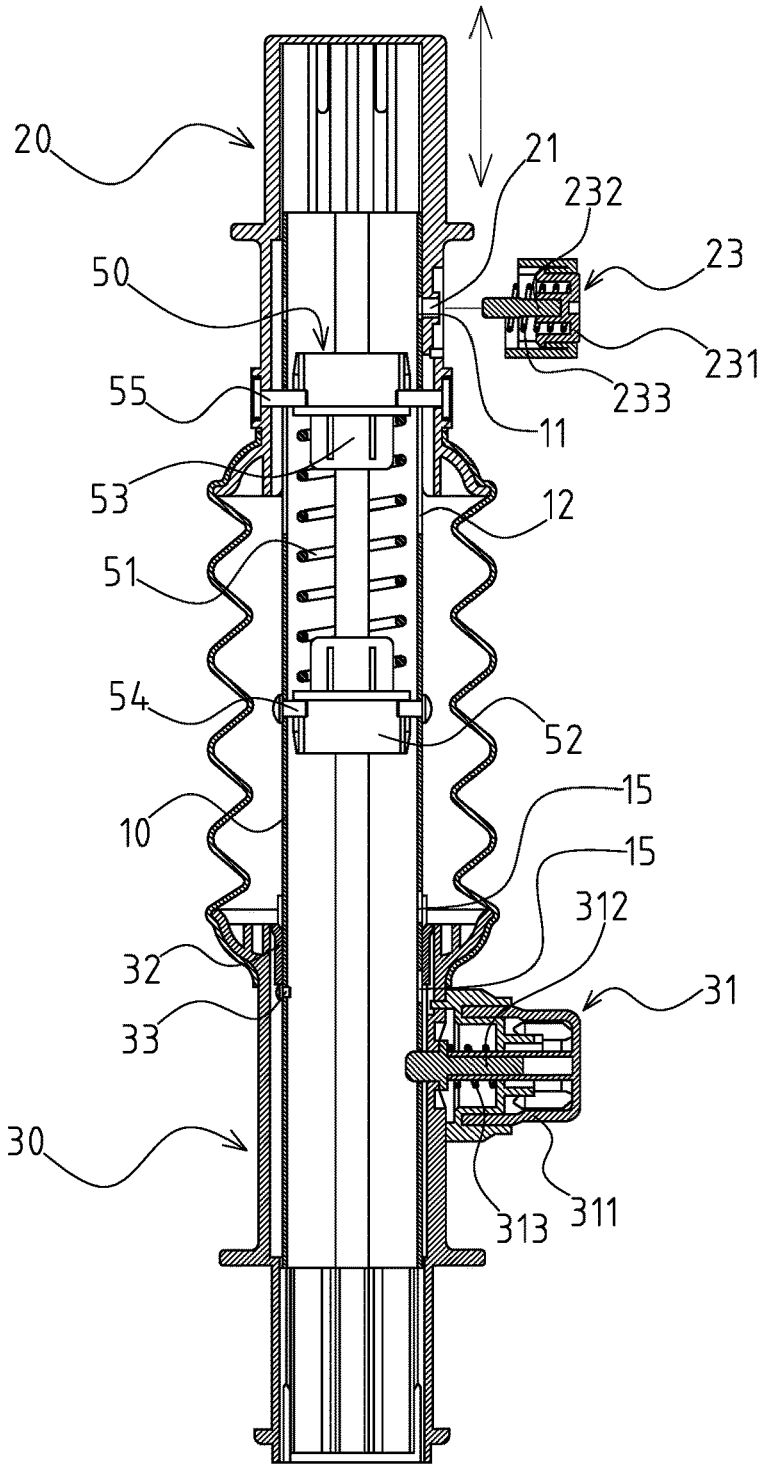
FIG. 6 is a cross-sectional view of the bouncing support structure for baby walker in accordance with the present invention when disassembling the first locking device.
Figure 7:
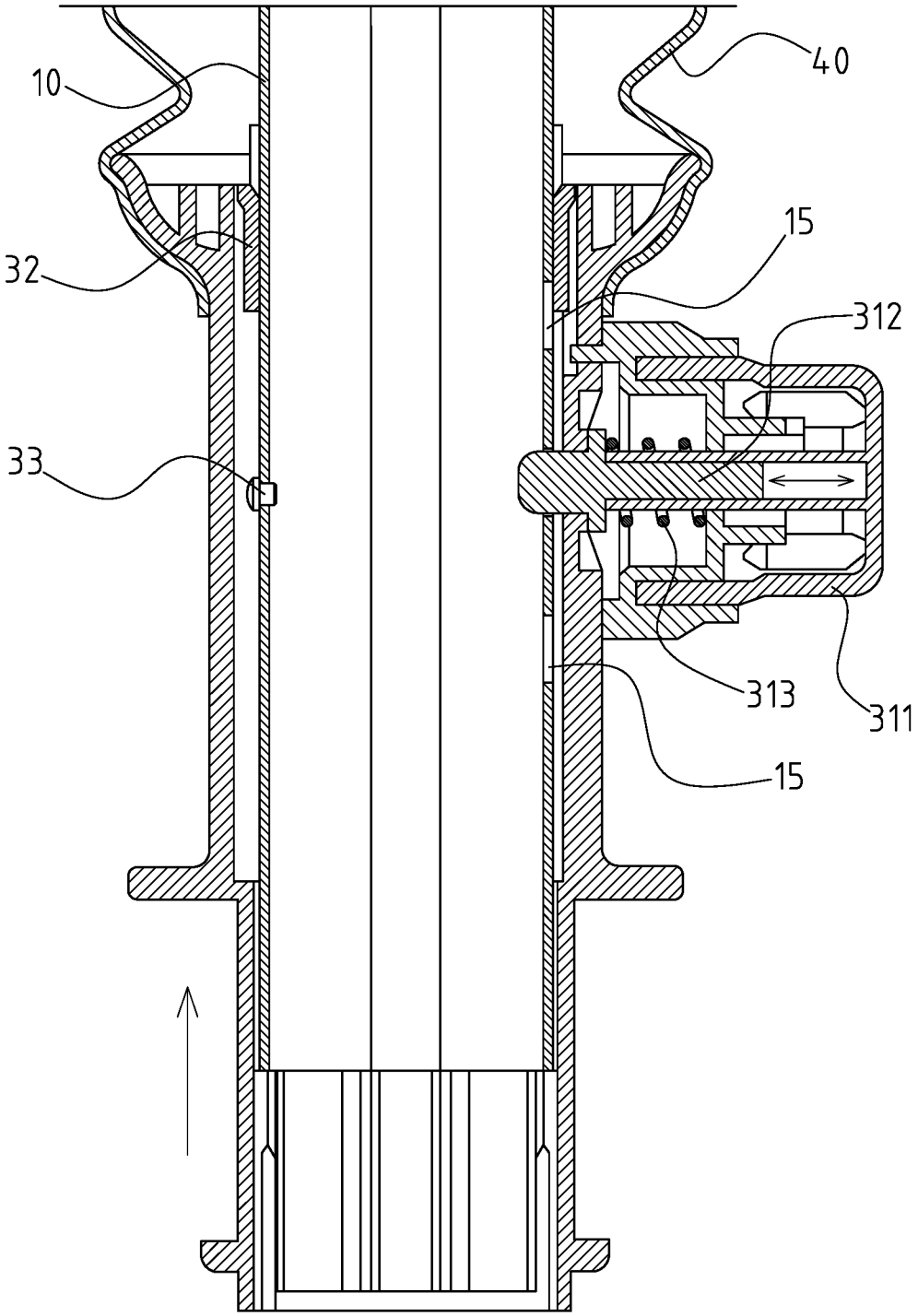
FIG. 7 is a partially cross-sectional view of the bouncing support structure for baby walker in accordance with the present invention when the total height is adjusted.

The lower housing 30 includes a second locking device 31 detachably mounted thereto. The second locking device 31 includes a second knob 311 rotatably and detachably mounted to the lower housing 30. A second pin 312 is longitudinally secured to the second knob 311. A second spring 313 is sleeved on the second pin 312, wherein the second spring 313 has two opposite ends respectively abutting against the lower housing 30 and the second knob 311. The second pin 312 sequentially extends through the lower housing 30 and inserted into a corresponding one of the multiple bores 15 in the tubular stand 10 when the second knob 311 is mounted to the lower housing 30 such that the lower housing 30 is positioned relative to the tubular stand 10. With reference to FIGS. 6 and 7, the total length of the bouncing support structure in accordance with the present invention and the height of the upper frame 82 of the baby walker are adjusted when the second pin 312 inserted into different bores 15. The lower housing 30 has a stop ring 32 disposed on a top portion thereof. A stopper 33 is securely inserted into the locking hole 14 and extends through the tubular stand 10. The stopper 33 selectively stops the lower housing 30 to prevent the lower housing 30 from being detached from the lower end of the tubular stand 10.

The resilient device 50 includes a spring 51 compressively received in the tubular stand 10. The spring 51 has a lower end connected to a first block 52 and an upper end connected to a second block 53. The resilient device 50 further includes two first locking pins 54 and two second locking pins 55, wherein each first locking pin 54 extends through a corresponding one of the two second through holes 13 in the tubular stand 10 and inserted into the first block 52 such that the first block 52 is positioned relative to the tubular stand 10, and each second locking pin 55 extends through a corresponding one of the two longitudinal slots 12 and inserted into the second block 53. In the preferred embodiment of the present invention, the cross-sections of the first block 52 and the second block 53 are complemental relative to the tubular stand 10. In addition, the compressive length of the spring 51 is longer than that of each of the two longitudinal slots 12 in the tubular stand 10.

Figure 2:
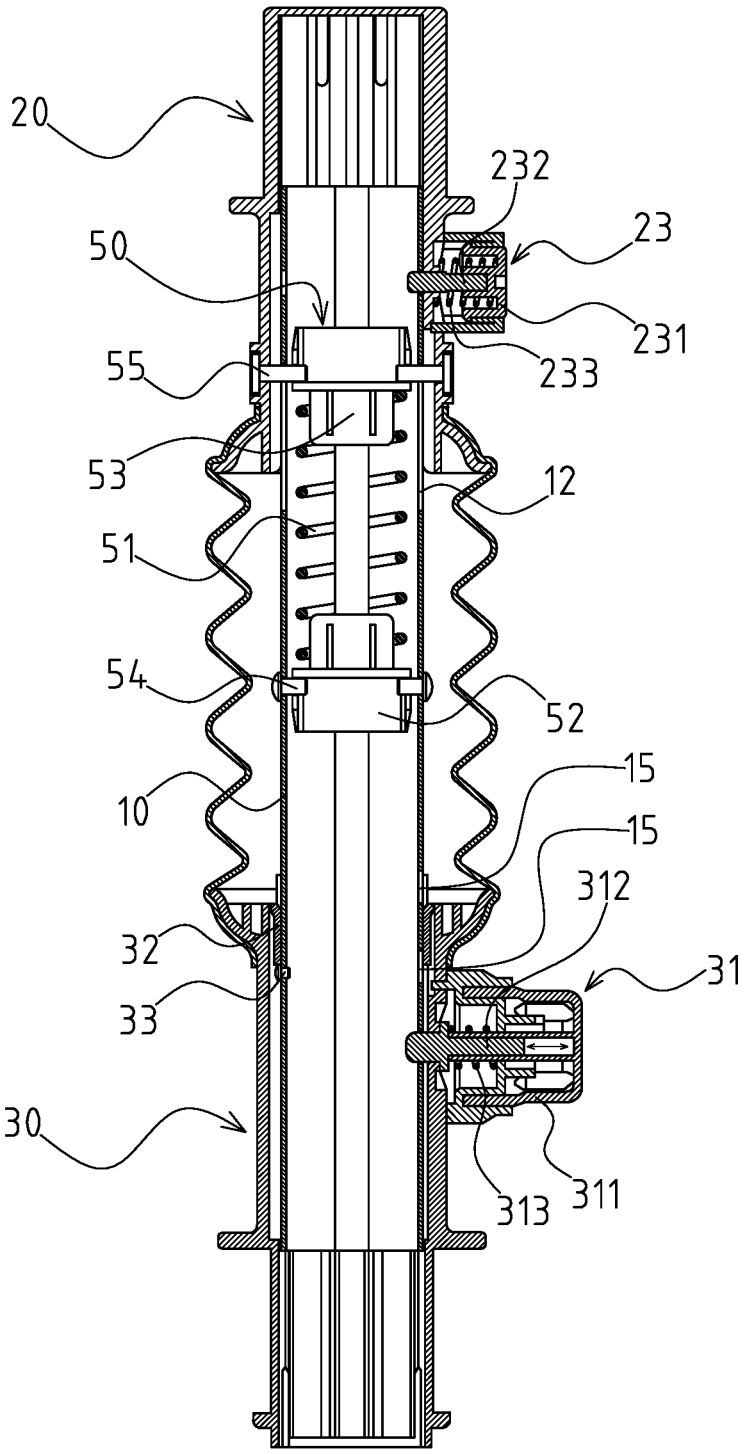
FIG. 2 is a cross-sectional view of a bouncing support structure for baby walker in accordance with the present invention.
Figure 3:
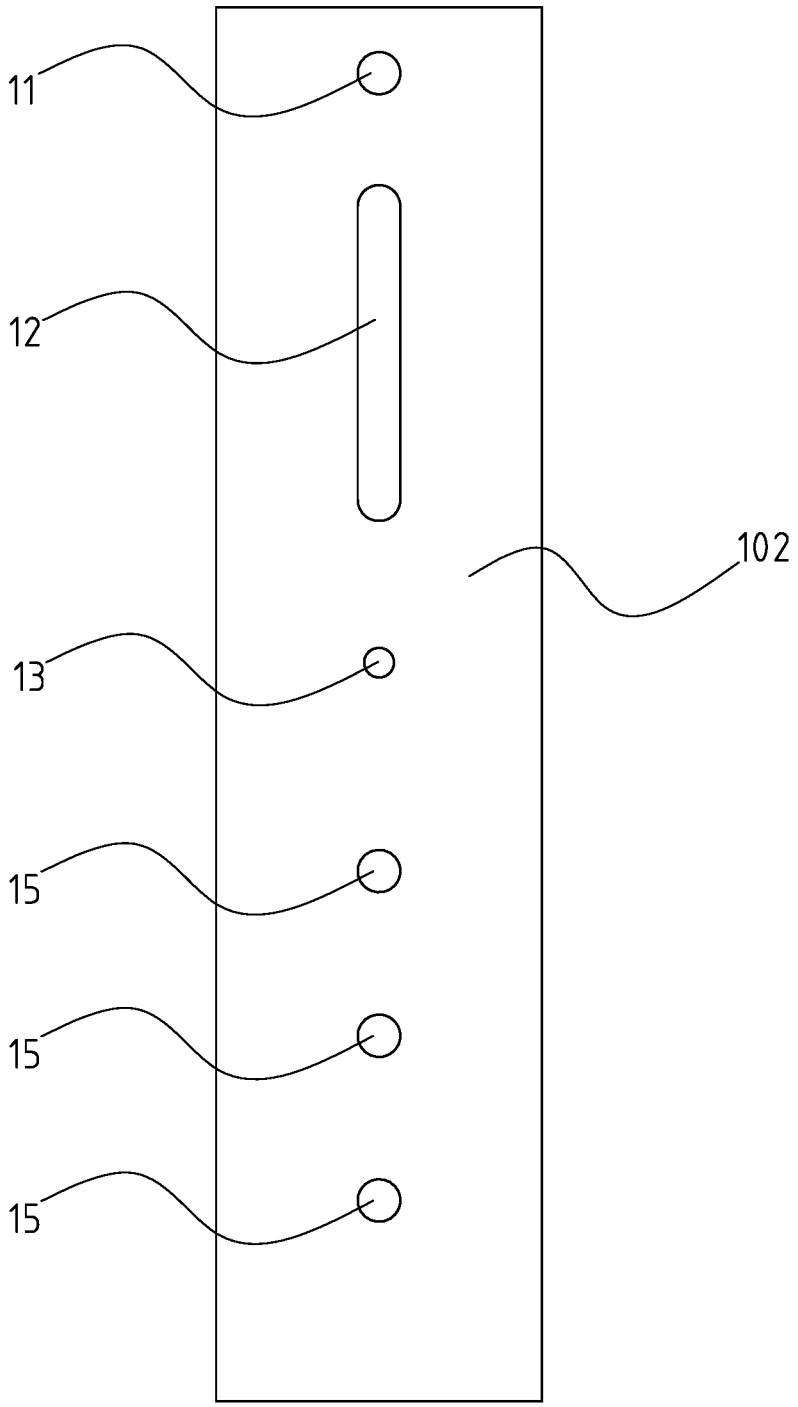
FIG. 3 is an outer side plan view of a tubular stand of the bouncing support structure in accordance with the present invention.
Figure 4:
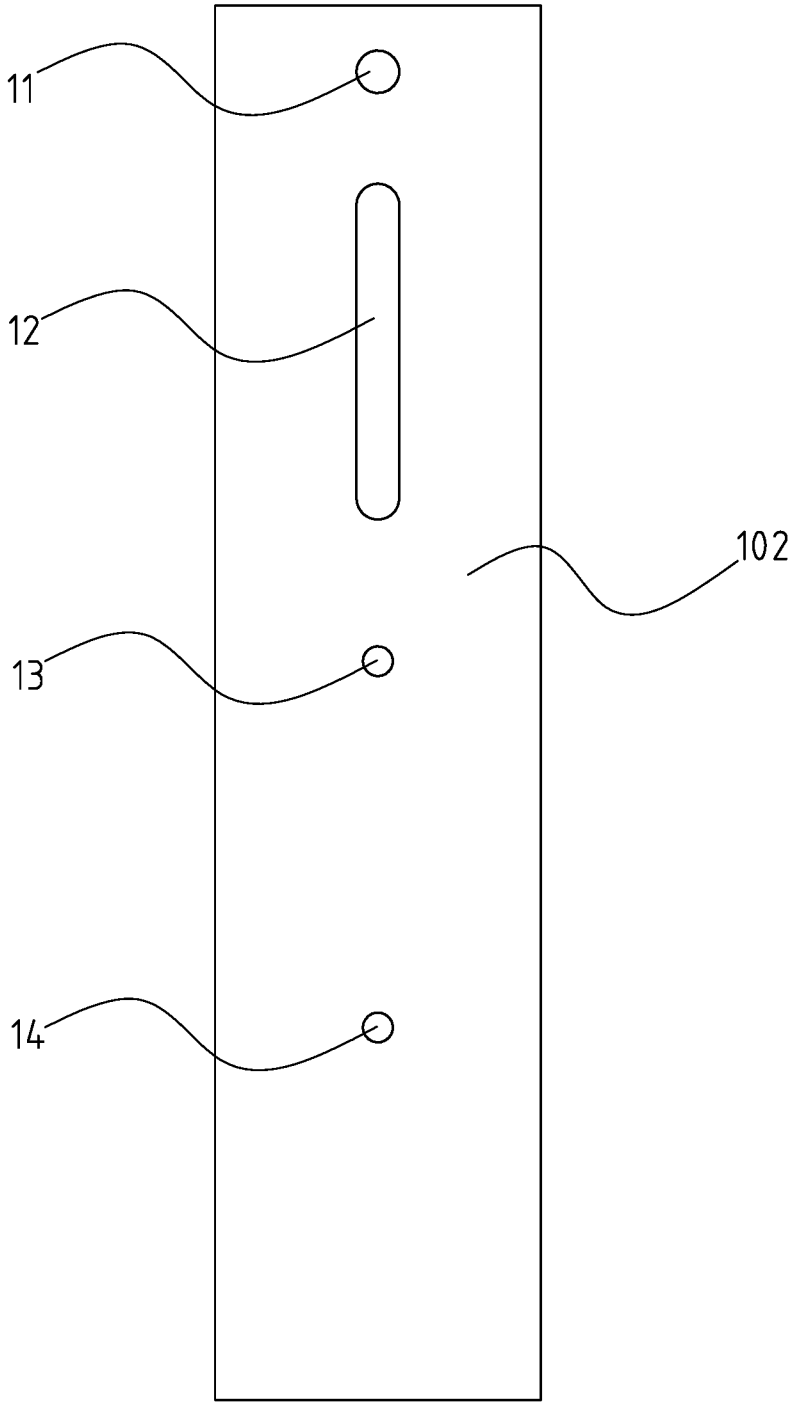
FIG. 4 is an inner side plan view of a tubular stand of the bouncing support structure in accordance with the present invention.

With reference to FIGS. 1, 2 and 6, the upper housing 20 and the second block 53 are reciprocally and longitudinally moved relative to the tubular stand 10 and provide the bouncing function to the baby walker when the first knob 231 is rotated and the first pin 232 is detached from the first through hole 11 in the tubular stand 10. Each second locking pin 55 is reciprocally moved in a corresponding one of the two longitudinal slots 12 for limiting a moving range of the upper housing 20 and the second block 53 when the upper housing 20 and the second block 53 are free relative to the tubular stand 10.

When using the bouncing support structure in accordance with the present invention to adjust the total height of the baby walker, with reference to FIGS. 2 and 7, the lower housing 30 is reciprocally moved relative to the tubular stand 10 when the second knob 30 is rotated and the second pin 312 is detached from the bore 15 where the second pin 312 originally inserted into. The second pin 312 is inserted into another bore 15 after the lower housing 30 being moved to a purposed position such that the horizontal height of the upper frame 80 of the baby walker is adjusted.

As described above, the horizontal height of the upper frame 80 of the baby walker is adjustable. Consequently, the baby walker, having the bouncing support structure in accordance with the present invention, has an adjustable horizontal height such that the using scope of the baby walker is enlarged. In addition, the bouncing support structure provides a bouncing function the baby walker. As a result, a using inserting of the baby walker is promoted.

Although the invention has been explained in relation to its preferred embodiment, it is to be understood that many other possible modifications and variations can be made without departing from the spirit and scope of the invention as hereinafter claimed.

I claim:

1. A bouncing support structure for baby walker, comprising:

a tubular stand formed with an inner portion and an outer portion, the inner portion and the outer portion respectively including a first through hole, a longitudinal slot and second through hole defined therein, wherein the two first through holes diametrically correspond to each, the two longitudinal slots diametrically correspond to each other and the two second through hole diametrically correspond to each other, the inner portion of the tubular stand having a locking hole defined therein under the second through hole in the inner portion of the tubular stand, multiple bores defined in the outer portion under the second through hole in the outer portion;

an upper housing sleeved on an upper end of the tubular stand and adapted to be connected to an upper frame of the baby walker, wherein the upper housing is selectively and reciprocally moved relative to the tubular stand, the upper housing having a first through hole and a second through hole defined therein, wherein the first through hole in the upper housing aligns and communicates with a corresponding one of the two first through holes in the tubular stand and the second through hole in the upper housing aligns and communicates with a corresponding one of the two longitudinal slot, a first locking device detachably mounted to the upper housing, the first locking device including a first knob rotatably and detachably mounted to the upper housing, a first pin longitudinally secured to the first knob, a first spring sleeved on the first pin, wherein the first spring has two opposite ends respectively abutting against the upper housing and the first knob, the first pin sequentially extending through the first through hole in the upper housing and the first through hole in the tubular stand when the first knob is mounted to the upper housing such that the upper housing is positioned relative to the tubular stand, a lower housing sleeved on an lower end of the tubular stand and adapted to be connected to an lower frame of the baby walker, wherein the lower housing is selectively and reciprocally moved relative to the tubular stand, the lower housing including a second locking device detachably mounted thereto, the second locking device including a second knob rotatably and detachably mounted to the lower housing, a second pin longitudinally secured to the second knob, a second spring sleeved on the second pin, wherein the second spring has two opposite ends respectively abutting against the lower housing and the second knob, the second pin sequentially extending through the lower housing and inserted into a corresponding one of the multiple bores in the tubular stand when the second knob is mounted to the lower housing such that the lower housing is positioned relative to the tubular stand, the total length of the bouncing support structure and the height of the upper frame of the baby walker are adjusted when the second pin inserted into different bores, the lower housing having a stop ring disposed on a top portion thereof, a stopper securely inserted into the locking hole and extending through the tubular stand, wherein the stopper selectively stops the lower housing to prevent the lower housing from being detached from the lower end of the tubular stand;

an expandable tube sleeved on the tubular stand, wherein the expandable tube has two opposite ends respectively longitudinally connected to the upper housing and the lower housing; and a resilient device received in the tubular stand, the resilient device having two opposite ends respectively secured on the upper housing and the tubular stand, the resilient device including a spring compressively received in the tubular stand, the spring having a lower end connected to a first block and an upper end connected to a second block, the resilient device further including two first locking pins and two second locking pins, wherein each first locking pin extends through a corresponding one of the two second through holes in the tubular stand and inserted into the first block such that the first block is positioned relative to the tubular stand, and each second locking pin extends through a corresponding one of the two longitudinal slots and inserted into the second block, wherein the compressive length of the spring is longer than that of each of the two longitudinal slots in the tubular stand.

2. The bouncing support structure as claimed in claim 1, wherein the multiple bores longitudinally align with one another.

3. The bouncing support structure as claimed in claim 1, wherein the expandable tube is made of flexible material and has a continued wave-shaped structure.

4. The bouncing support structure as claimed in claim 1, wherein the cross-sections of the first block and the second block are complemental relative to the tubular stand.

5. The bouncing support structure as claimed in claim 1, wherein the upper housing and the lower housing respectively have a smooth and curved inner periphery, and the tubular stand has a smooth and curved outer periphery for easily sleeving the upper housing and the lower housing to the upper end and the lower end of the tubular stand.

6. The bouncing support structure as claimed in claim 4, wherein the upper housing and the lower housing respectively have a smooth and curved inner periphery, and the tubular stand has a smooth and curved outer periphery for easily sleeving the upper housing and the lower housing to the upper end and the lower end of the tubular stand.

* * * * *